US006499613B1

(12) United States Patent
Grau et al.

(10) Patent No.: US 6,499,613 B1
(45) Date of Patent: Dec. 31, 2002

(54) COUPLER WITH EXTENDED EMERGENCY RELEASE AND TOWING FEATURE

(75) Inventors: Curtiss A. Grau, Duncan; George C. Mullis, Greer, both of SC (US)

(73) Assignee: Westinghouse Air Brake Company, Wilmerding, PA (US)

( * ) Notice: Subject to any disclaimer, the term of this patent is extended or adjusted under 35 U.S.C. 154(b) by 0 days.

(21) Appl. No.: 09/475,842

(22) Filed: Dec. 30, 1999

(51) Int. Cl.[7] ..... B61G 11/00
(52) U.S. Cl. ..... 213/7; 213/75 R
(58) Field of Search ..... 213/75 R, 62 R, 213/7, 10

(56) References Cited

U.S. PATENT DOCUMENTS 5,305,899 A * 4/1994 Kaufhold ..... 213/50
5,312,007 A * 5/1994 Kaufhold et al. ..... 213/75 R
5,360,124 A * 11/1994 Wurzer et al. ..... 213/62 R
5,598,937 A * 2/1997 Clark ..... 213/62 R

* cited by examiner

*Primary Examiner*—S. Joseph Morano
*Assistant Examiner*—Robert J. McCarry, Jr.
(74) *Attorney, Agent, or Firm*—James Ray & Associates

(57) ABSTRACT

A vehicular coupler comprises a head for coupling to an opposed, generally identical coupling head of a vehicle for mechanically connecting two vehicles together. Such coupler includes a beam member for connecting to the underside of one of such vehicles. A housing is slideably connected to the beam member and a cushioning device is connected to the coupling head. The coupling head has a rearward extension located in the housing. Primary shear bolts or pins extend through walls of the housing and into the rearward extension of the cushioning device. Secondary shear bolts or pins extend through the beam member and into the housing. Retaining bolts are secured to the housing and have upper portions located above an upper surface of the housing. A longitudinal relief area is provided in the beam member, with the upper portions of the retaining bolts being located in the relief area. The relief area terminates at a predetermined location in the beam member to provide a ledge for engagement with and retention of the upper portions of the retaining bolts when the primary and secondary shear bolts or pins are sheared in two and the coupling head and housing are moved forwardly relative to the beam member.

14 Claims, 1 Drawing Sheet

COUPLER WITH EXTENDED EMERGENCY RELEASE AND TOWING FEATURE

FIELD OF THE INVENTION

The present invention relates, in general, to couplers for mechanically connecting together adjacently disposed ends of a pair of mass transit type rail vehicles and, more particularly, the invention relates to couplers that include a drawbar/draft gear appliance that prevents damage to such vehicles and provides dissipation of energy to vehicle frames during a collision and, still more specifically, the present invention provides couplers which include extended free travel beneath the cars so that collision energy absorbing members of a car are not interfered with in a collision, the invention including further a towing feature after release mechanisms have been operative in the collision process.

BACKGROUND OF THE INVENTION

Prior to the development of the present invention, mass transit type railway cars have been constructed with a soft, or collapsible, coupler apparatus so that engaging portions of the apparatus of two such railway cars may accordion, or collapse, under the force of a collision. These railway cars require couplers having a substantial distance of relief travel during collision in order to prevent damage to both the couplers and to the railway cars.

Drawbar/draft gear release mechanisms are presently used to provide the required extended free travel. The release mechanisms can include a primary shear device (bolts) to permit the railway cars to come together so that anti-climbers on the ends of the cars are effective to prevent the end of the trailing railway car from overriding the lead railway car. A secondary release mechanism can provide a telescoping drawbar to release at a higher buffing force then the primary shear device.

However, with presently existing release designs, it is not possible to tow a mass transit type railway car after the release mechanisms have functioned without the drawbar portions separating. Damaged railway cars thus have to be towed from the end opposite the collision, or be pushed, to a location where maintenance on the cars can be effected.

OBJECTIVES OF THE INVENTION

It is, therefore, one of the primary objects of the present invention to provide a coupler with an extended emergency release and towing feature which will allow a damaged mass transit type railway car to be towed from its damaged end after its drawbar/draft gear appliance releases.

Another object of the present invention is to provide a coupler with an extended emergency release and towing feature in which the towing can be made directly through the drawbar/draft gear appliance without having to separate damaged cars and without having to push such cars to a maintenance location.

Still another object of the present invention is to provide a coupler with an extended release travel by use of secondary release bolts, or pins, after which the above towing feature is present for moving damaged cars.

Yet another object of the present invention is to provide a coupler with an extended emergency release and towing feature in which the coupler can be readily retrofitted onto existing mass transit type railway cars.

BRIEF SUMMARY OF THE INVENTION

The above objectives are accomplished, according to one embodiment of the invention, by use of a beam member located for pivotal connection to the underside of a railway vehicle and a housing slideably connected to the beam member. Cushioning means are connected to a coupling head of a car. The coupling head has a rearward extension located in the slideable housing. Primary shear means, such as bolts, extend through the walls of the housing and into the rearward extension of the cushioning means and such car coupler. Secondary shear means, such as another set of bolts, extend through the beam member and into the slideable housing. A third set of "retention" bolts are located in the lower housing but have an upper portion, such as heads of the bolts, located in a horizontal slot or recess provided in the upper beam member. The slot, or recess, is forwardly terminated to provide a ledge against which the upper heads, or portions, of the retaining means can engage when the coupler head is translated forwardly, thereby pulling the lower housing with the coupler head such as when the damaged car or cars are towed. Thus, the upper head portions of the retention means in combination with the horizontal slot, or recess, and its forward edge provide means for towing after the primary and secondary shear devices have been sheared in two in a collision.

BRIEF DESCRIPTION OF THE DRAWINGS

The invention, along with its objectives and advantages discussed above, will be better understood from consideration of the following detailed description and the accompanying drawings in which.

BRIEF DESCRIPTION OF A PRESENTLY PREFERRED EMBODIMENT OF THE INVENTION

Figure 1:
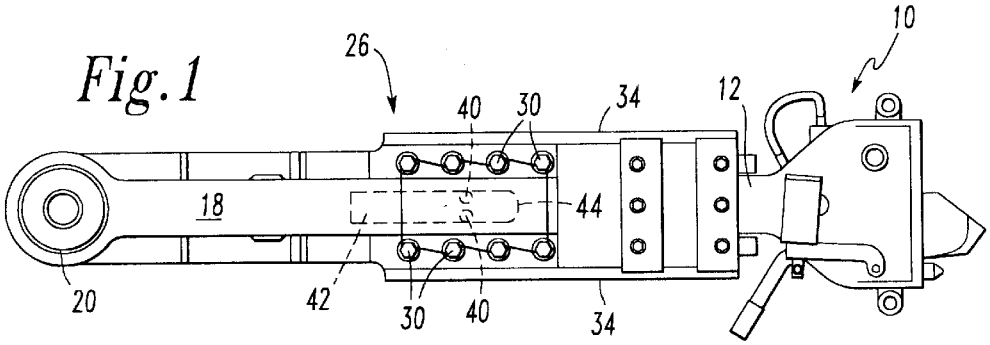
FIG. 1 is a plan view of a presently preferred embodiment of a drawbar/draft gear appliance constructed according to the instant invention.

Prior to proceeding to the more detailed description of the present invention, it should be noted that identical components which have identical functions have been identified with the same reference numerals throughout the several views illustrated in the drawing figures for the sake of clarity and understanding of the invention. "Buffing" as used in this application is a generally well recognized railway term describing compressive forces. "Draft", on the other hand, is a generally well recognized railway term describing tension forces.

Figure 2:
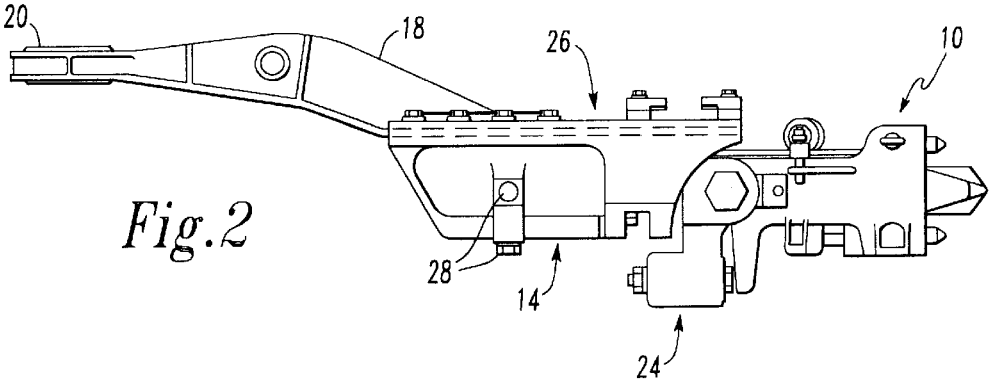
FIG. 2 is a side elevation view of the drawbar/draft gear appliance illustrated in FIG. 1.

Reference is now made, more particularly to FIG. 1 of the drawings. Illustrated therein is a coupler head, generally designated 10, of a first transit car (not shown) for coupling to an identical coupler head of a second transit car (not shown). The coupler head 10 includes an integral rearwardly extending member 12 located in a lower housing member 14 (FIG. 2). The lower housing member 14 has an upper bearing surface 16 (FIG. 3) upon which rests, in a slideable manner, an upper hollow beam member 18.

At the rear and left outermost end of such upper hollow beam member 18, in FIGS. 1 and 2, is an integral circular member 20 that is employed to rotatably secure the beam member 18 to the underside of a transit car. Circular member 20 is secured to the transit car underside in a manner that allows such beam member 18 to swivel about the vertical center axis of such integral circular member 20.

The lower housing member 14 includes an internal pocket 22 (FIG. 3) that houses a rearward portion of a cushioning device or draft gear 24 (FIG. 2). Draft gear 24 transmits normal draft and buff forces from such coupler head 10 to and through the housing member 14 and upper beam member 18 to the body of the car via attachment member 20.

The combination of such draft gear 24, the lower housing member 14, the upper beam member 18 and integral circular attachment member 20 comprises a drawbar appliance, which drawbar appliance is labeled generally by the reference numeral 26 in the drawing figures.

In the figures of the drawings, the drawbar appliance 26 is provided with two, primary and secondary collision release mechanisms in the form shear bolts 28 and 30 respectively. The shear bolts 28 extend through the side and bottom walls of the lower housing 14 and into the portion of the cushioning device 24 that is located in pocket 22 of the lower housing 14.

These shear bolts 28 are the primary release mechanism and when a predetermined rearward force is imposed upon the coupling head 10, bolts 28 shear in two allowing cushioning device 24 and coupler head 10 to travel rearwardly thereby permitting the cars to come together. Anti-climbers, located on the ends of the transit car bodies, come together and prevent the trailing transit car from overriding the lead transit car in the collision process.

Figure 3:
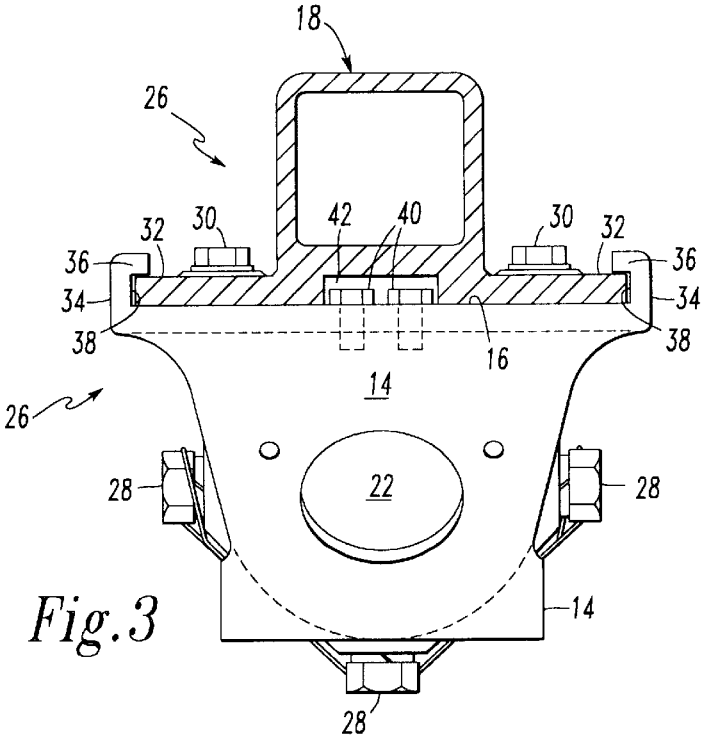
FIG. 3 is an end elevation view of a lower housing of the drawbar/draft gear appliance, illustrated in FIGS. 1 and 2, with the upper beam member of such drawbar/draft gear appliance being shown in cross-section.

Bolts 30 provide the secondary release mechanism when a collision force increases above the force necessary to shear the primary bolts 28 and to a predetermined force capable of shearing bolts 30. Bolts 30 extend through the upper beam member 18 and into an upper portion of such lower housing 14, as best seen in FIG. 3 of the drawings.

More particularly, the upper beam member 18 includes opposed integral flanges 32 resting on a bearing surface 16 of the lower housing 14. The lower surface of such upper beam member 18 is also a bearing surface that engages the bearing surface 16 to provide relative sliding of the two surfaces.

The lower housing member 14 is provided with opposed upper flanges 34 having inwardly directed flange portions 36 that will slideably secure such upper beam member 18 to the lower housing member 14, i.e., the inwardly directed flange portions 36 in combination with bearing surface 16 of the lower housing member 14 provide opposed pockets, or slots 38, sized to loosely but securely receive the edges of the opposed flanges 32 of the upper beam member 18.

When the second, greater predetermined collision force occurs, bolts 30 shear in two to provide "extended" rearward travel of the coupler head 10 and such lower housing member 14. This extended travel is substantially greater than that provided by the travel of coupler head 10 and cushioning device 24 in the lower housing member 14 when bolts 28 shear. The extended travel can be up to twenty additional inches.

With the occurrence of a release of both of the mechanisms 28 and 30, the lower housing member 14 is ordinarily free to separate from the upper beam member 18 when the transit cars subjected to such release forces are towed, i.e., after a collision of such release magnitude. In this case, the transit cars are often damaged to the extent that they must be towed to a repair facility. To prevent such transit cars from separating, the cars must either be pushed to a repair facility or be towed from an end of the car opposite the sheared mechanisms if, of course, the drawbar appliance at such opposite end is intact.

To tow such damaged transit cars, the presently preferred embodiment of the invention provides a retention means in the form of bolt heads 40 (FIG. 3) located in a longitudinally extending relief area, or slot 42, provided in the upper beam member 18. The shanks of such bolts 38 will through the bearing surface 16 of such lower housing member 14 and into the body portion of the lower housing member 14. The slot 42 terminates at a forward location 44 to provide an upstanding ledge in the upper beam member 18. Such upstanding ledge is visible only in dash outline in FIG. 1 of the drawings.

When both the primary and secondary shear bolts 28 and 30, respectively, shear in two and a pulling force is imposed on coupler head 10 in towing the associated transit car to a repair location, the lower housing member 14 and retention bolts 40, the shanks of which are located in the lower housing 14, are translated forwardly by the coupler until the heads of bolts 40 engage forward ledge 44. The upper beam member 18 and the lower housing 14 are now mechanically engaged by the bolt heads and ledge so that car(s) can be towed at the end of the transit car suffering the collision impact and sheared bolts.

The shear mechanisms 28 and 30 and the retention means 40 are depicted in the drawing figures as bolts. Such mechanisms and means can, of course, be pins or other like devices, as such devices serve the same function as bolts and bolt heads.

While the presently preferred embodiment for carrying out the instant invention has been set forth in detail above, those persons skilled in the coupling art to which this invention pertains will recognize various alternative ways of practicing the invention without departing from the spirit and scope of the patent claims appended hereto.

We claim:

1. A vehicular coupler, said vehicular coupler comprising:

(a) a coupling head for coupling to an opposed, generally identical, coupling head of a vehicle for mechanically connecting two vehicles together;

(b) a beam member for connecting to an underside of one of such vehicles;

(c) a housing member slideably connected to said beam member;

(d) a cushioning member connected to said coupling head and having a rearward extension located in said housing member;

(e) primary shear means extending through walls of said housing member and into said rearward extension of said cushioning member; and (f) secondary shear means extending through said beam member and into said housing member, the shearing of said primary shear means allowing the cushioning means to move rearwardly a distance that is less than the distance of rearward travel with shearing of the secondary shear means.

2. A vehicular coupler, according to claim 1, wherein said vehicular coupler further includes a longitudinal relief area provided in said beam member.

3. A vehicular coupler, according to claim 2, wherein said vehicular coupler further includes a retaining means secured to said housing member to allow towing of a vehicle from the end thereof having said shear means sheared in two, said retaining means having upper portions located above an upper surface of said housing member and with said upper portions of said retaining means being located in said longitudinal relief area.

4. A vehicular coupler, according to claim 3, wherein said relief area terminates at a location in said beam member to provide a ledge for engagement with and retention of said upper portions of said retaining means when said primary and secondary shear means are sheared in two and said coupling head and housing member are moved forwardly relative to said beam member.

5. A vehicular coupler, according to claim 4, wherein said beam member is generally hollow.

6. A vehicular coupler, according to claim 4, wherein said cushioning means is a draft gear.

7. A vehicular coupler, said vehicular coupler comprising:

(a) a coupling head for coupling to an opposed, generally identical, coupling head of a railway transit vehicle for mechanically connecting two railway transit vehicles together;

(b) a beam member for connecting said vehicular coupler to an underside of one of such railway transit vehicles;

(c) a housing member slideably connected to said beam member;

(d) a cushioning means connected to said coupling head and having a rearward extension located in said housing member;

(e) primary shear bolts extending through walls of said housing member and into said rearward extension of said cushioning means; and (f) secondary shear bolts extending through said beam member and into said housing member the shearing of said primary shear means allowing the cushioning means to move rearwardly a distance that is less than the distance of rearward travel with shearing of the secondary shear means.

8. A vehicular coupler, according to claim 7, wherein said vehicular coupler further includes a longitudinal relief area provided in said beam member.

9. A vehicular coupler, according to claim 8, wherein said vehicular coupler further includes retaining bolts or pins secured to said housing member, said retaining bolts or pins having upper head portions located above an upper surface of said housing member, and with the upper head portions of said retaining means being located in said longitudinal relief area.

10. A vehicular coupler, according to claim 9, wherein said relief area terminates at a location in said beam member to provide a ledge for engagement with and retention of the upper head portions of said retaining means when said primary and secondary shear bolts are sheared in two and said coupling head and housing member are moved forwardly relative to said beam member.

11. A vehicular coupler, according to claim 10, wherein said beam member is generally hollow.

12. A vehicular coupler, according to claim 11, wherein said cushioning means is a draft gear.

13. A vehicular coupler, according to claim 12, wherein said beam member includes a means to facilitate connection of said coupler to such underside of such transit vehicle.

14. A vehicular coupler, according to claim 13, wherein said means to facilitate connection of said coupler to such underside of such transit vehicle is a generally circular aperture formed through said beam member.

* * * * *